US010981637B1

(12) United States Patent
Alby et al.

(10) Patent No.: US 10,981,637 B1
(45) Date of Patent: Apr. 20, 2021

(54) APPARATUSES FOR SUPPORTING OUTBOARD MOTORS WITH RESPECT TO MARINE VESSELS

(71) Applicant: Brunswick Corporation, Mettawa, IL (US)

(72) Inventors: Jeremy L. Alby, Oshkosh, WI (US); Darin C. Uppgard, Oshkosh, WI (US); Wayne M. Jaszewski, Jackson, WI (US)

(73) Assignee: Brunswick Corporation, Mettawa, IL (US)

( * ) Notice: Subject to any disclaimer, the term of this patent is extended or adjusted under 35 U.S.C. 154(b) by 371 days.

(21) Appl. No.: 16/043,280

(22) Filed: Jul. 24, 2018

(51) Int. Cl.
*B63H 20/10* (2006.01)
*B63H 20/06* (2006.01)

(52) U.S. Cl.
CPC ..... *B63H 20/10* (2013.01); *B63H 20/06* (2013.01)

(58) Field of Classification Search
CPC ..... B63H 20/10; B63H 20/06
See application file for complete search history.

(56) References Cited

U.S. PATENT DOCUMENTS 4,052,952 A * 10/1977 Hale ..... F02B 61/045 440/52
4,354,847 A * 10/1982 Blanchard ..... B63H 20/10 440/61 R
4,354,848 A * 10/1982 Hall ..... B63H 21/26 248/642
4,367,860 A * 1/1983 Strang ..... B63H 20/10 248/641
4,384,856 A * 5/1983 Hall ..... B63H 20/10 248/642
4,391,592 A * 7/1983 Hundertmark ..... B63H 20/10 440/53
4,402,675 A * 9/1983 Eichinger ..... B63B 21/08 248/643
4,406,632 A * 9/1983 Blanchard ..... B63H 20/10 248/642
4,472,148 A * 9/1984 Kollock ..... B63H 20/10 440/53
4,637,800 A * 1/1987 Slattery ..... B63H 20/08 440/55
4,757,971 A * 7/1988 Mapes ..... B63H 20/06 248/550

(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

An apparatus is for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

29 Claims, 12 Drawing Sheets

(56) References Cited

U.S. PATENT DOCUMENTS 4,763,871 A * 8/1988 Probst ..... B63H 20/08 248/640
4,813,897 A * 3/1989 Newman ..... B63H 20/06 248/641
4,826,459 A * 5/1989 Slattery ..... B63H 20/08 440/55
4,836,124 A * 6/1989 Haasl ..... B63B 39/061 114/285
4,836,811 A * 6/1989 Griffiths ..... B63H 20/06 248/642
4,846,740 A * 7/1989 Forsgren ..... B63H 20/10 440/53
4,861,292 A * 8/1989 Griffiths ..... B63H 20/10 440/1
4,872,857 A * 10/1989 Newman ..... B63H 21/265 440/1
4,872,859 A * 10/1989 Griffiths ..... B63H 20/06 440/53
4,925,410 A * 5/1990 Boda ..... B63H 21/265 248/642
5,026,308 A * 6/1991 Sumigawa ..... B63H 20/10 248/640
5,169,350 A * 12/1992 Tsujii ..... B63H 20/10 248/642
5,344,350 A * 9/1994 Hatch ..... B63H 20/32 123/195 P
5,382,183 A * 1/1995 Rompre ..... B63H 20/10 248/641
5,405,274 A * 4/1995 Cook, III ..... B63H 20/007 440/6
5,647,780 A * 7/1997 Hosoi ..... B63H 20/12 440/53
5,855,496 A * 1/1999 Lokken ..... B63H 20/10 440/53
6,146,220 A * 11/2000 Alby ..... B63H 20/08 248/642
6,149,476 A * 11/2000 Eilert ..... B63B 7/087 114/357
6,183,321 B1 * 2/2001 Alby ..... B63H 20/08 440/53
6,494,431 B1 * 12/2002 McCoy ..... B63H 20/10 248/640
7,156,709 B1 * 1/2007 Staerzl ..... B63H 20/10 440/61 G
7,198,530 B1 * 4/2007 Rothe ..... B63H 20/02 440/52
7,311,571 B1 * 12/2007 Swan ..... B63H 20/10 440/53
3,011,982 A1 9/2011 Baier et al.
8,011,982 B1 * 9/2011 Baier ..... B63H 20/12 440/53
9,376,191 B1 * 6/2016 Jaszewski ..... B63H 20/245
9,475,560 B1 * 10/2016 Jaszewski ..... B63H 20/002
9,701,383 B1 * 7/2017 Stuber ..... B63H 20/06
9,745,036 B2 * 8/2017 Andrasko ..... G05D 1/0206
9,963,213 B1 * 5/2018 Jaszewski ..... B63H 20/06
2004/0262488 A1 * 12/2004 Kozubski ..... B63H 20/106 248/642
2017/0355432 A1 * 12/2017 Mizutani ..... B63H 20/10

* cited by examiner

APPARATUSES FOR SUPPORTING OUTBOARD MOTORS WITH RESPECT TO MARINE VESSELS

FIELD

The present disclosure relates to marine drives for propelling marine vessels, and more particularly to apparatuses for supporting outboard motors with respect to marine vessels.

BACKGROUND

The following U.S. Patents are incorporated herein by reference:

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,745,036 discloses a trim control system automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed. If the user has not chosen to refine the aggressiveness, the controller determines the setpoint trim angle from the selected base profile. However, if the user has chosen to refine the aggressiveness, the controller determines the setpoint trim angle from a trim sub-profile, which defines a variant of the relationship between vessel speed and trim angle defined by the selected base profile. The control system positions the propulsion device at the setpoint trim angle.

U.S. Pat. No. 9,701,383 discloses a marine propulsion support system including a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a supporting cradle, and a drive unit supported between first and second opposite arms of the supporting cradle. First and second vibration isolation mounts connect the first and second supporting cradle arms to the drive unit, respectively. An upper motion-limiting bump stop is located remotely from the vibration isolation mounts and between the swivel bracket and the drive unit.

U.S. Pat. No. 9,376,191 discloses an outboard motor to be coupled to a transom of a marine vessel including a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

U.S. Pat. No. 4,813,897 discloses a transom extension assembly for mounting an outboard motor in a spaced relation to the boat transom includes a quadrilateral linkage assembly in which each of the functions to trim, tilt and lift the motor with respect to the transom is provided independently. Each function is provided by a separate hydraulic cylinder means, but operating fluid pressure is supplied by a single fluid pressure source which may be mounted directly on the transom extension linkage.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples, an apparatus is for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. Advantageously, the trim axis is located aftwardly of the first trim actuator pivot axis so that added clearance is provided between the marine vessel and the outboard motor when the outboard motor is trimmed upwardly.

In other non-limiting examples, a tilt actuator is pivotally coupled to the transom bracket at a first tilt actuator pivot axis and to the trim actuator at a second tilt actuator pivot axis. Extension of the tilt actuator moves the supporting cradle and trim axis aftwardly away from the transom and retraction of the tilt actuator moves the trim axis forwardly towards the transom.

In still other non-limiting examples, a climbing gear connects the supporting cradle to a stationary gear on the transom bracket. Extension of the trim actuator causes the climbing gear to rotate about the stationary gear which effectively moves the trim axis upwardly and aftwardly relative to the transom bracket.

In still other non-limiting examples, the supporting cradle is connected to the transom bracket via a camming slot along which the supporting cradle moves when the trim actuator is actuated. The camming slot guides the supporting cradle upwardly and aftwardly with respect to the transom bracket. This design can be programmed to provide the best combination of movement up/aft with respect to the individual boat application thus optimizing the outboard travel and position.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION OF THE DRAWINGS

Figure 1:
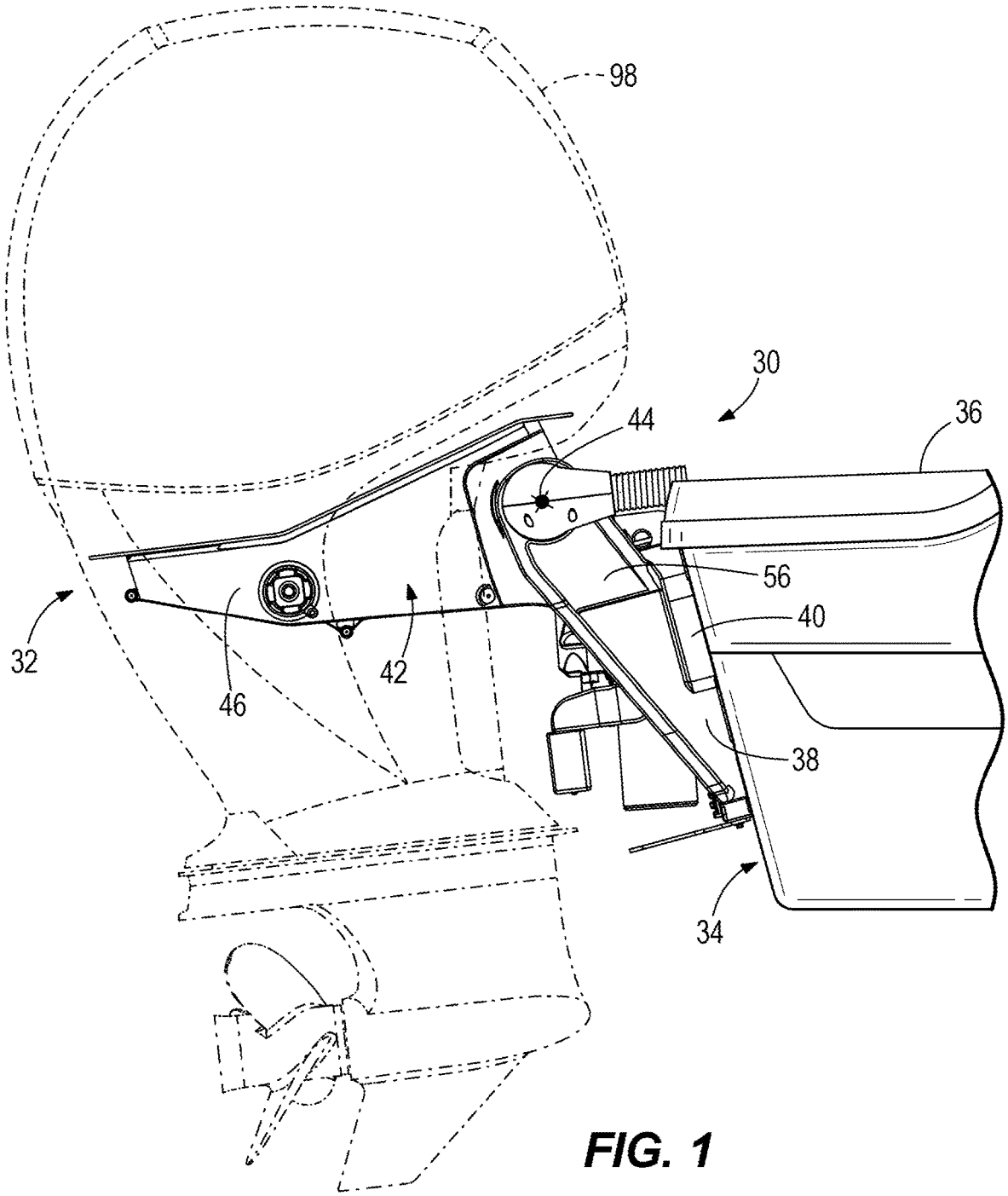
FIG. 1 depicts a first embodiment of an apparatus for supporting an outboard motor on a transom of a marine vessel.
Figure 2:
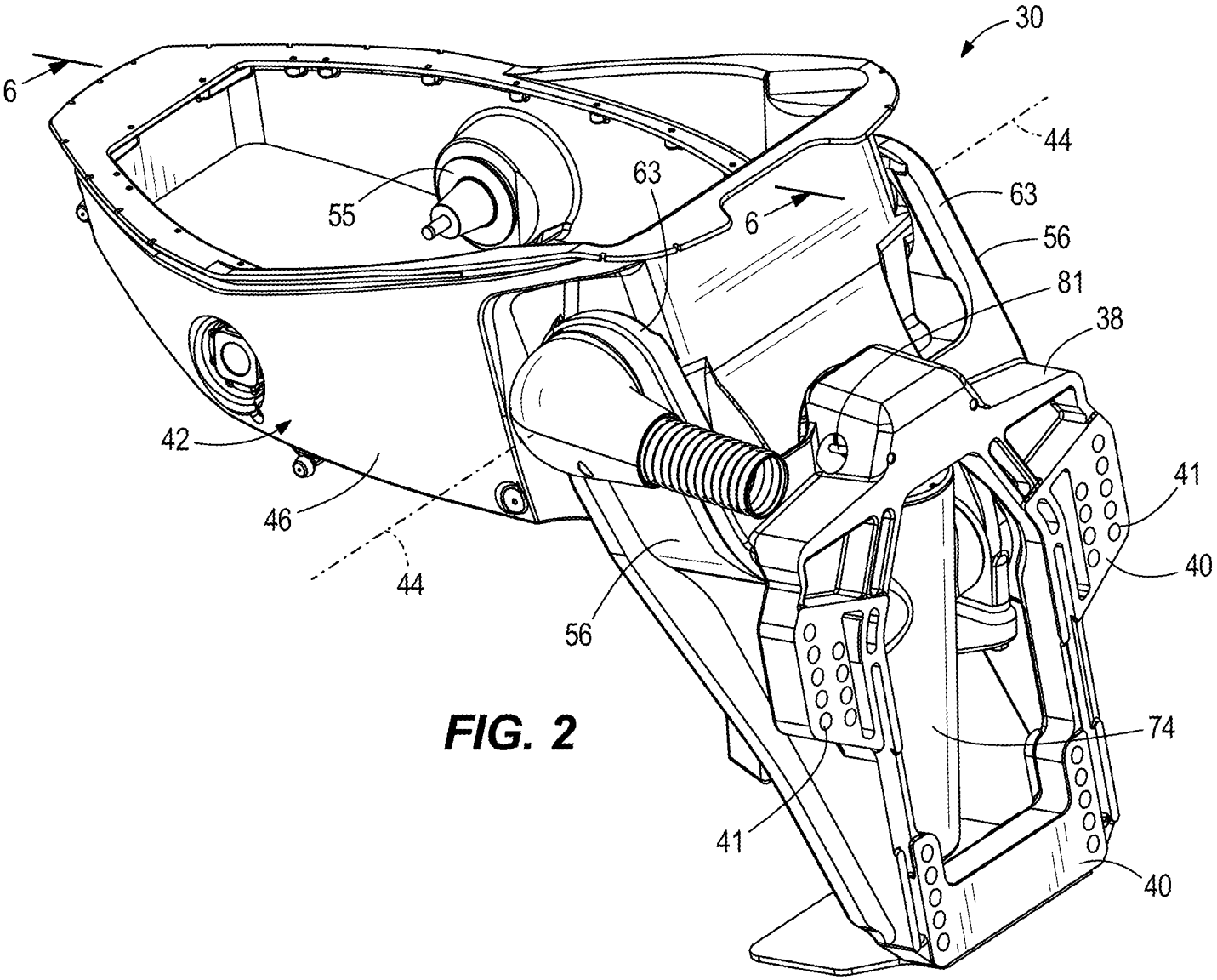
FIG. 2 is an isometric view looking down at the first embodiment.
Figure 3:
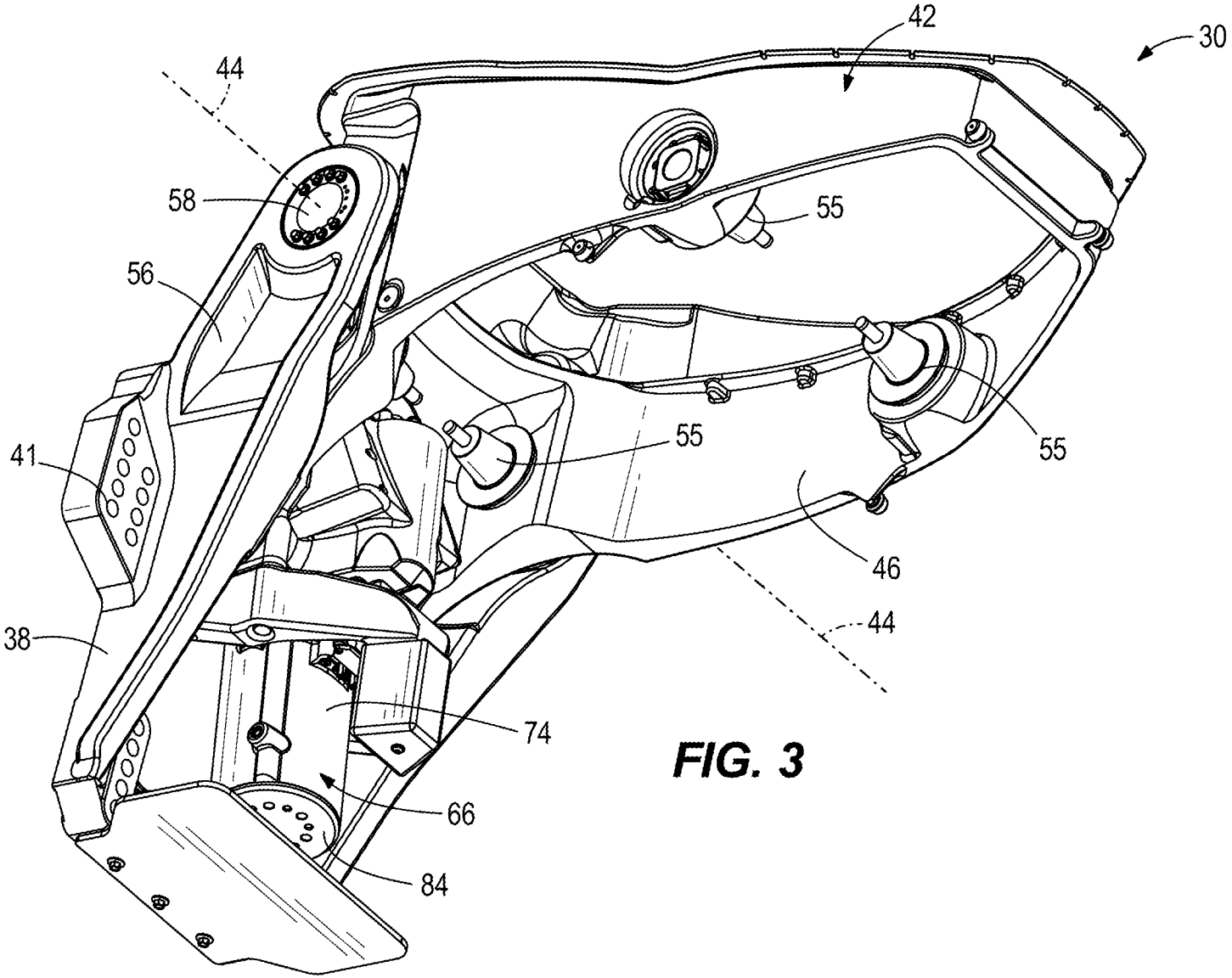
FIG. 3 is an isometric view looking up at the first embodiment.
Figure 4:
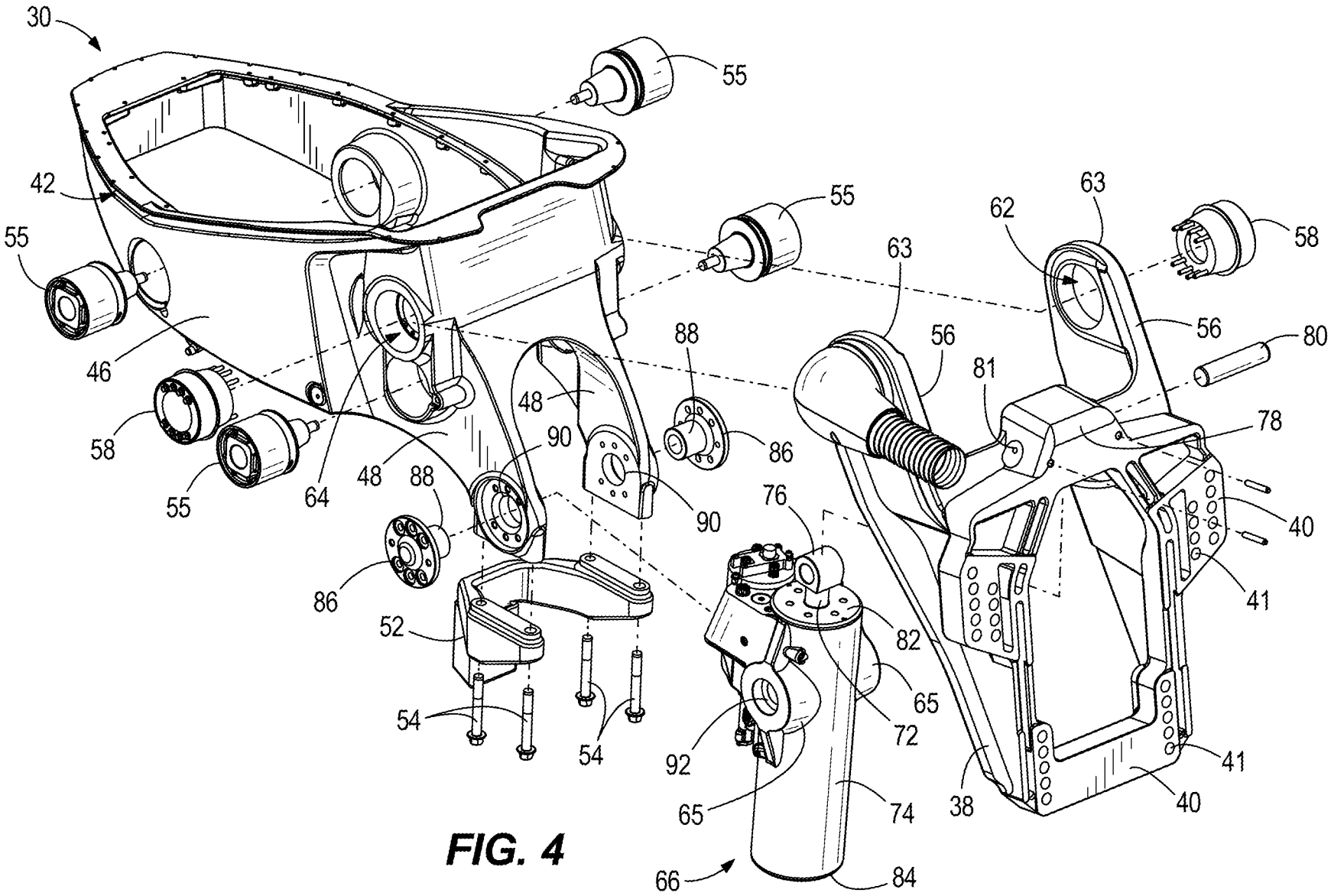
FIG. 4 is an exploded view looking down at the first embodiment.
Figure 5:
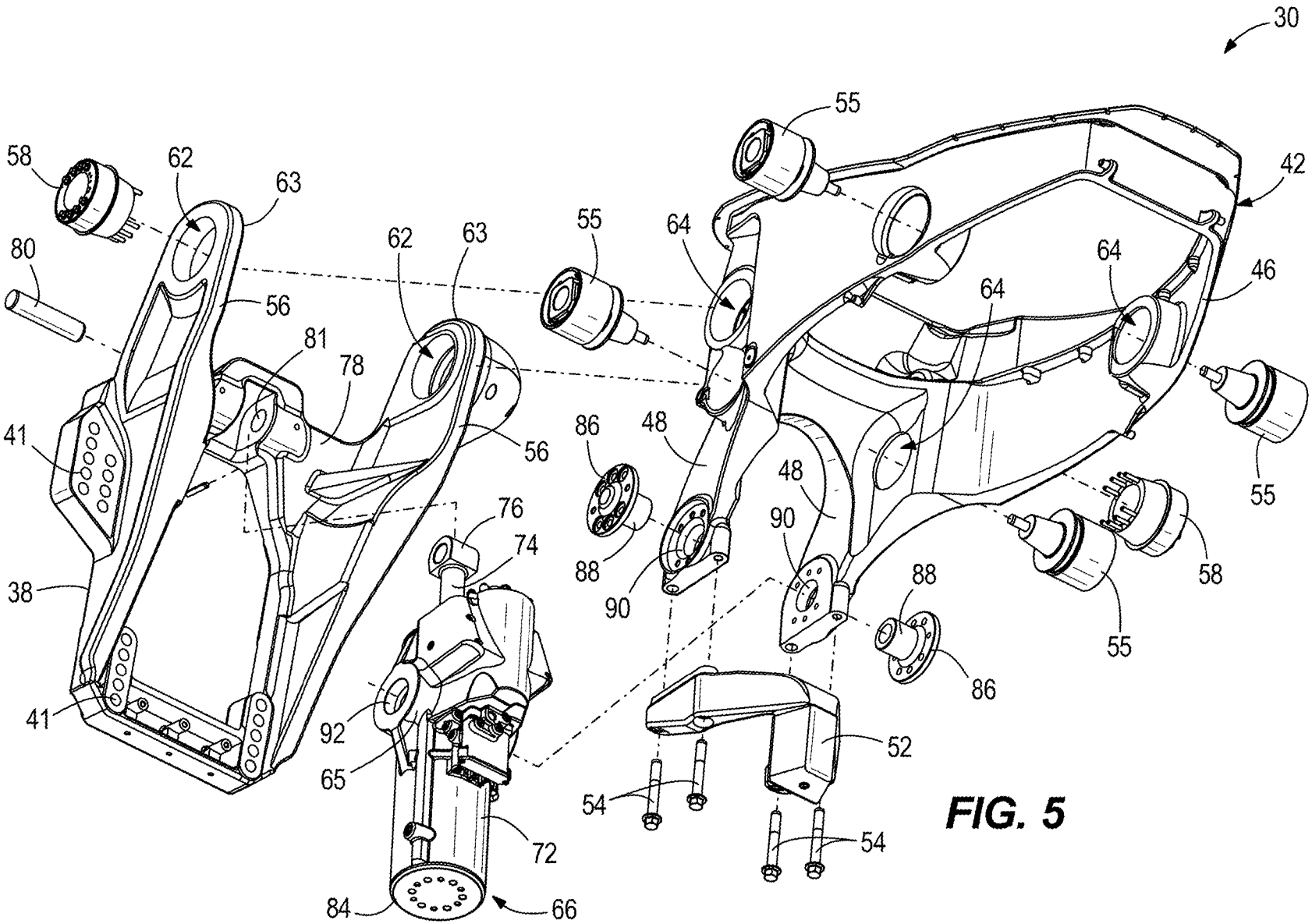
FIG. 5 is an exploded view looking up at the first embodiment.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

During research and development, the present inventors have determined that it is desirable to increase the horsepower capability of current outboard motors. To achieve this goal, current product offerings are being redesigned with larger engines and related components. The present inventors have also determined that it can be challenging to securely mount and maneuver a large outboard motor on the transom of a marine vessel without interference from the marine vessel and/or surrounding structures and components. For example, the inventors have determined that relatively larger outboard motors require increased clearance with respect to the transom and boat well of the marine vessel when the outboard motors are trimmed upwardly in to a raised position. Without enough clearance, the upper cowling of the outboard motor can collide with the transom well, causing damage. The present disclosure is a result of the present inventors' efforts to remedy this problem.

FIGS. 1-7 depict a first embodiment of an apparatus 30 for supporting an outboard motor 32 on a transom 34 of a marine vessel 36. The apparatus 30 has a transom bracket 38 configured for fixed attachment to the transom 34. The type and configuration of the transom bracket 38 can vary from what is shown. In the illustrated example, the transom bracket 38 has a mounting pedestal 40 that faces the transom 34. The mounting pedestal 40 has a plurality of mounting holes 41 for receiving fasteners, such as bolts (not shown), in a conventional manner. For example, the fasteners extend through the transom 34 and through the transom bracket 38 and thereby connect the transom bracket 38 to the transom 34 via, for example a threaded engagement between the fasteners and the mounting holes 41, or via threaded engagement between the fasteners and corresponding mounting bolts (not shown). Again, the manner of fixed engagement between the transom bracket 38 and the transom 34 is conventional and can vary from what is shown.

The apparatus 30 further includes a supporting cradle 42 that pivotally couples the outboard motor 32 to the transom bracket 38 along a trim axis 44. The type and configuration of the supporting cradle 42 can vary from what is shown. Further examples of suitable supporting cradles are disclosed in the above-incorporated U.S. Patents. In the illustrated example, the supporting cradle 42 has a body 46 that includes a frame that extends around the midsection of the outboard motor 32. A pair of opposing supporting arms 48 (see FIGS. 4 and 5) are integral with and extend downwardly from the body 46 and forwardly towards the transom bracket 38. The opposing supporting arms 48 have lower ends that are coupled together by a brace 52. The brace 52 can be connected to the lower ends 50 by fasteners 54 or in other examples could be formed as one piece with the supporting arms 48. Conventional resilient mounting members 55 (mounts) couple the supporting cradle body 46 and the brace 52 to the midsection of the outboard motor 32 so that the outboard motor 32 is resiliently supported with respect to the supporting cradle 42, for example as described in the above-incorporated U.S. Patents.

The transom bracket 38 has opposing bracket arms 56 that are integral with the mounting pedestal 40 and pivotally coupled to the supporting cradle 42 along the trim axis 44. The manner of connection between the opposing bracket arms 56 and the supporting cradle 42 can vary from what is shown. In the illustrated example, the two components are pivotally coupled together by opposing bushings 58, each having a stem that extends through bores 62 in upwardly extending ears 63 of the bracket arms 56 and into bores 64 in the aftward side of the supporting cradle body 46, above the supporting arms 48. The trim axis 44 is thus defined along the center axes of the opposing bushings 58 and respective bores 62, 64.

Figure 6:
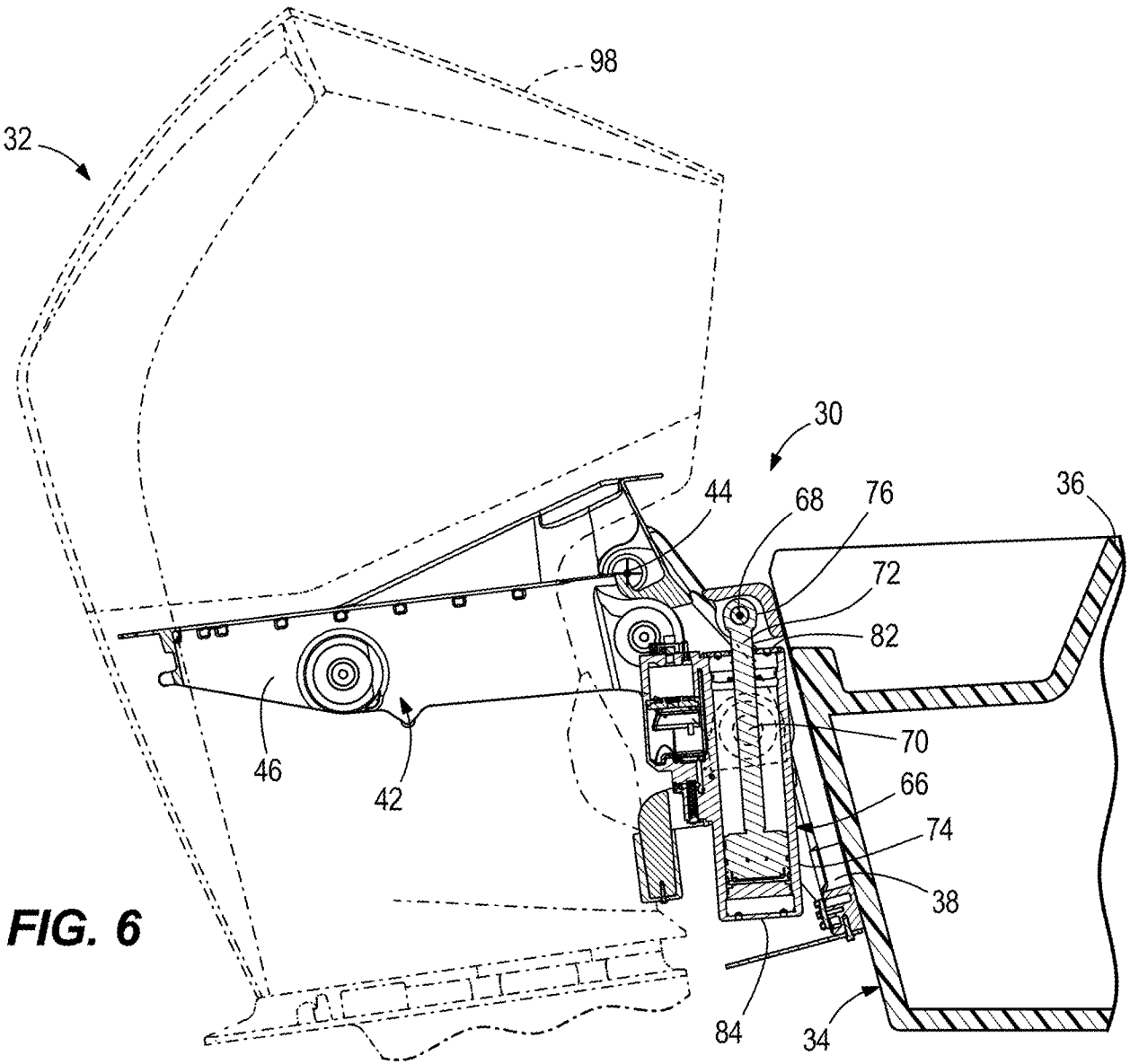
FIG. 6 is a side view of the first embodiment showing the outboard motor trimmed down into a lowered position.
Figure 7:
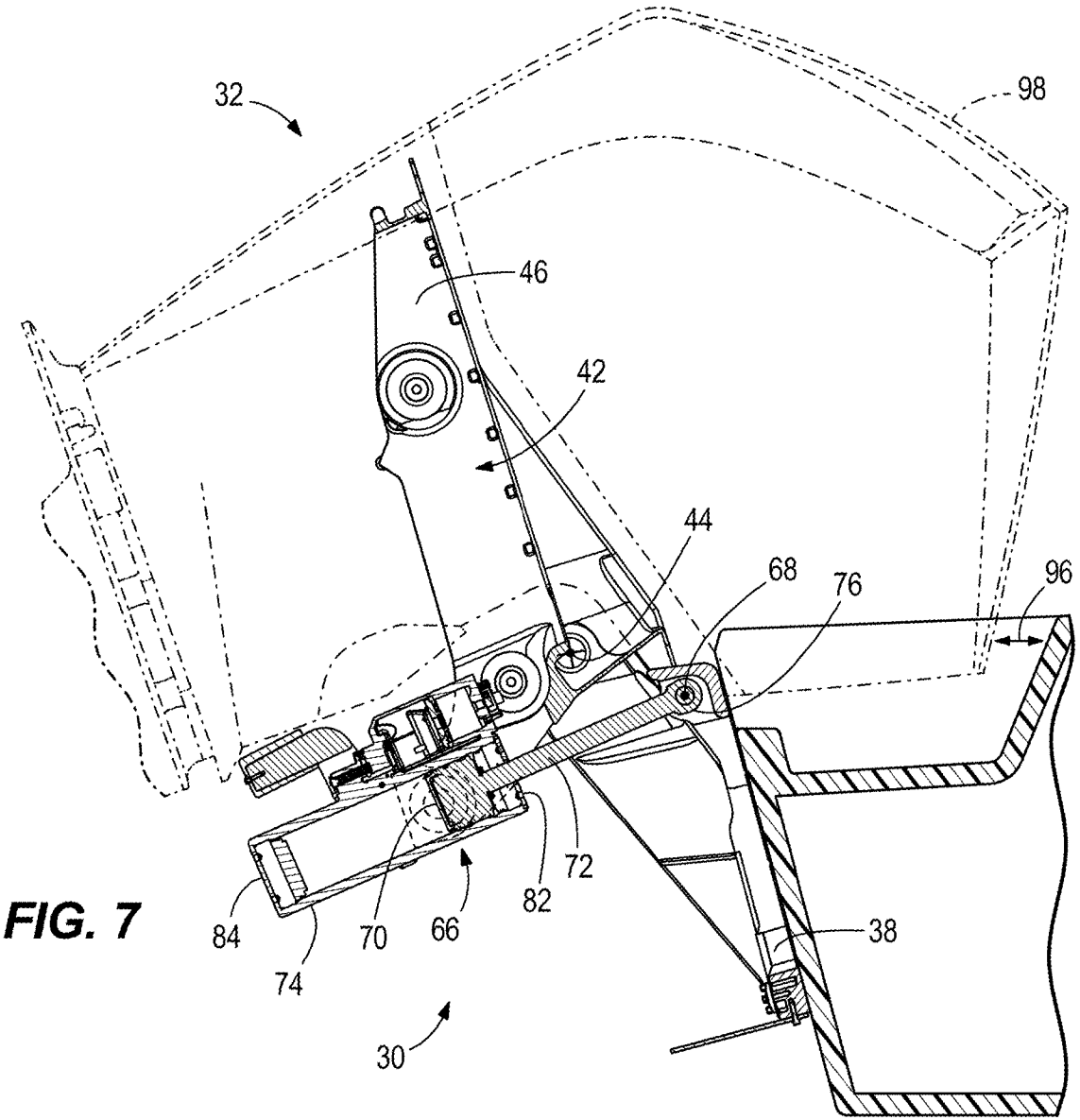
FIG. 7 is a side view of the first embodiment showing the outboard motor trimmed up into a raised position.

Referring to FIGS. 4-7, the apparatus 30 further includes a trim actuator 66 that is pivotally coupled to the transom bracket 38 along a first trim actuator pivot axis 68 and pivotally coupled to the supporting cradle along a second trim actuator pivot axis 70. As shown in FIGS. 6 and 7, extension of the trim actuator 66 pivots the supporting cradle 42 upwardly about the trim axis 44 and retraction of the trim actuator 66 pivots the supporting cradle 42 downwardly about the trim axis 44. The type and configuration of the trim actuator 66 can vary from what is shown. In the illustrated example, the trim actuator 66 includes a piston rod 72 and cylinder 74 in which the piston rod 72 reciprocates under, for example, hydraulic pressure from a conventional hydraulic system including a pump and associated valving, such as one of those disclosed in the above-incorporated US Patents. Other types of conventional trim actuators could be used, for example including but not limited to pneumatic cylinders and/or electric motors. In the first embodiment, the piston rod 72 and cylinder 74 are disposed between the opposing bracket arms 56 and between the supporting arms 48. The piston rod 72 is pivotally coupled to the transom bracket 38 along the first trim actuator pivot axis 68 and the cylinder 74 is pivotally coupled to the supporting cradle 42 along the second trim actuator pivot axis 70. The manner of connection can vary from what is shown. In the illustrated example, the top end of the piston rod 72 has an eyelet 76. The transom bracket 38 has a bridge 78 that connects the opposing bracket arms 56. A pivot pin 80 extends through a bore 81 in the bridge and also through the eyelet 76 so that the eyelet 76 is free to pivot about the pivot pin 80 and is laterally restrained by the bridge 78. The first trim actuator pivot axis 68 is thus defined along the center axis of the pivot pin 80 and the eyelet 76 allows the piston rod 72 to pivot about the pivot pin 80. The cylinder 74 has a top end 82 and a bottom end 84. The top end 82 of the cylinder 74 is located closer to the first trim actuator pivot axis 68 than the bottom end 84. A pair of bushings 86 have stems 88 that extend through bores 90 in the supporting arms 48 of the supporting cradle 42 and into bores 92 formed in bosses 65 on opposite sides of the cylinder 74 between the top end 82 and bottom end 84. The second trim actuator pivot axis 70 is thus defined along the center axes of the opposing bushings 86 and the bores 90, 92.

As shown in FIGS. 6 and 7, the trim axis 44 is located aftwardly of the first trim actuator pivot axis 68 relative to the marine vessel 36. The second trim actuator pivot axis 70 is located vertically below the first trim actuator pivot axis 68 when the trim actuator 66 is retracted. The second trim actuator pivot axis 70 is located aftwardly of the trim axis 44 when the trim actuator 66 is extended. Extension of the piston rod 72 from the cylinder 74 pivots the supporting cradle 42 upwardly about the trim axis 44. Retraction of the piston rod 72 from the cylinder 74 pivots the supporting cradle 42 downwardly about the trim axis 44. Extension of the piston rod 72 pivots the trim actuator 66 upwardly about the trim axis 44. Retraction of the piston rod 72 pivots the trim actuator 66 back downwardly about the trim axis 44. Extension and retraction of the piston rod 72 rotates the trim actuator 66 about the first trim actuator pivot axis 68.

Advantageously, as shown in FIG. 7, the location of the trim axis 44 aftwardly of the first actuator pivot axis 68 provides additional clearance 96 between the top cowl 98 of the outboard motor 32.

Figure 8:
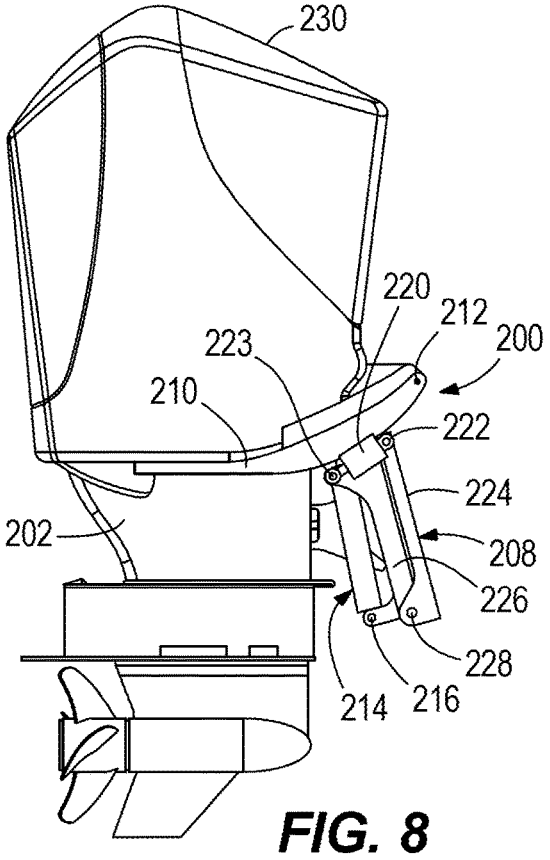
FIG. 8 is a side view of a second embodiment of an apparatus for supporting an outboard motor, showing the outboard motor in a first trimmed-down position.
Figure 9:
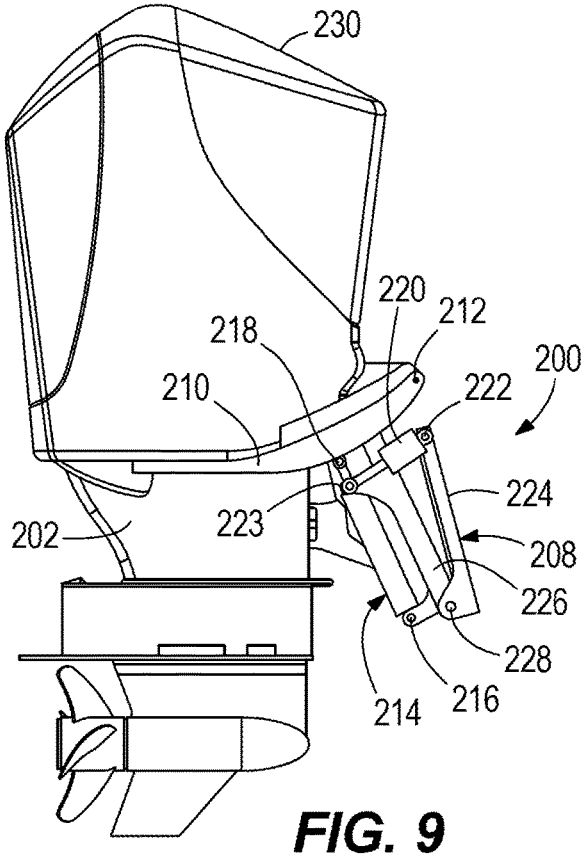
FIG. 9 is a side view of the second embodiment showing the outboard motor in a second trimmed-down position.
Figure 10:
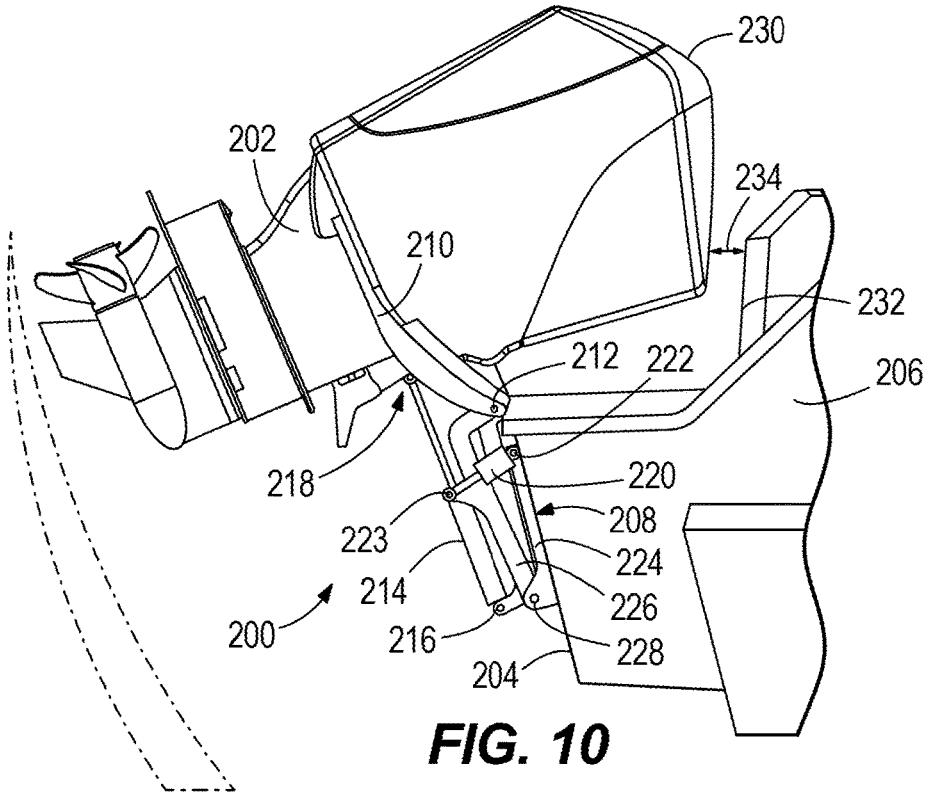
FIG. 10 is a side view of the second embodiment in a trimmed-up position.
Figure 13:
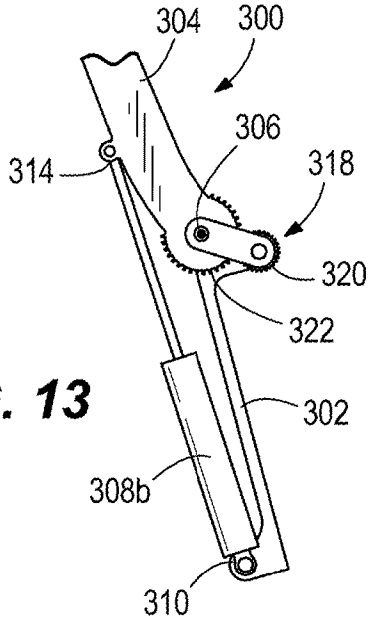
FIG. 13-14 are side and perspective views of the third embodiment, shown in a trimmed-up position.
Figure 14:
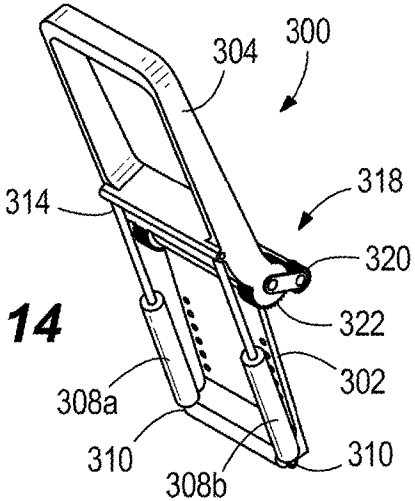
Figure 11:
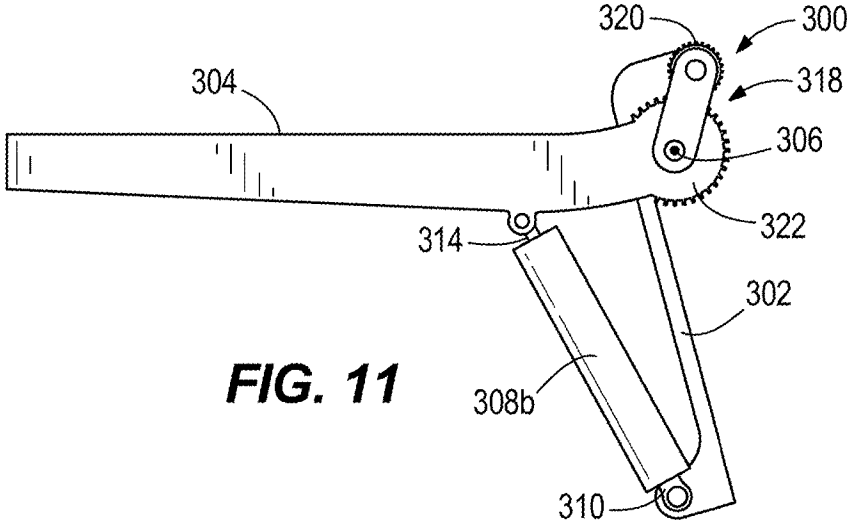
FIGS. 11-12 are side and perspective views of a third embodiment of an apparatus for supporting an outboard motor, shown in a trimmed-down position.
Figure 12:
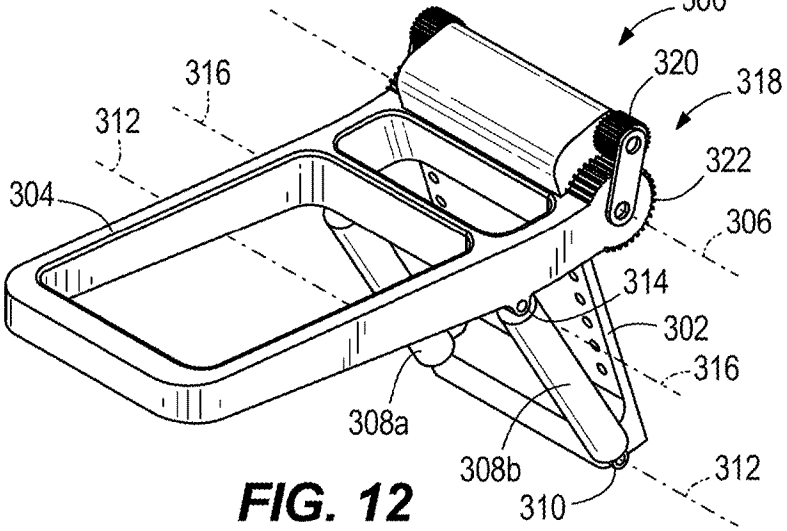
Figure 17:
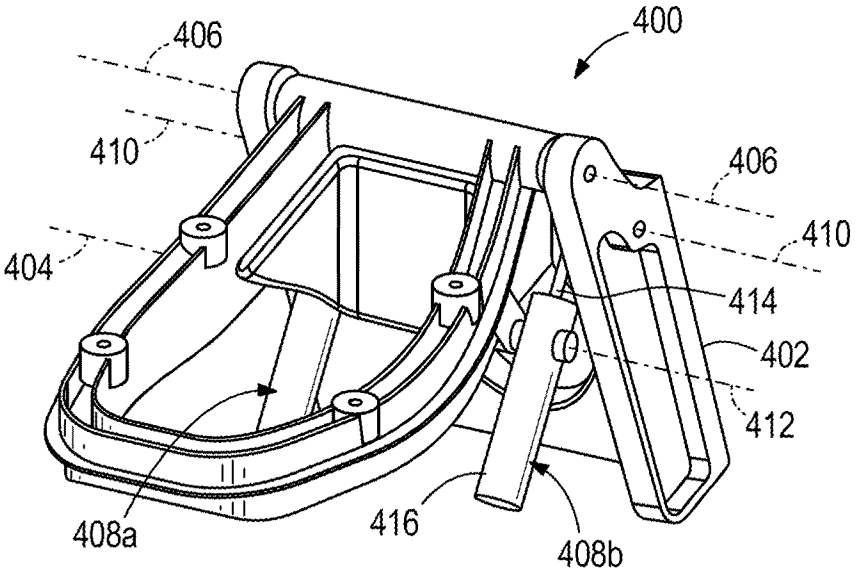
FIG. 17-18 are perspective and side views of the fourth embodiment, shown in a trimmed-down position.
Figure 18:
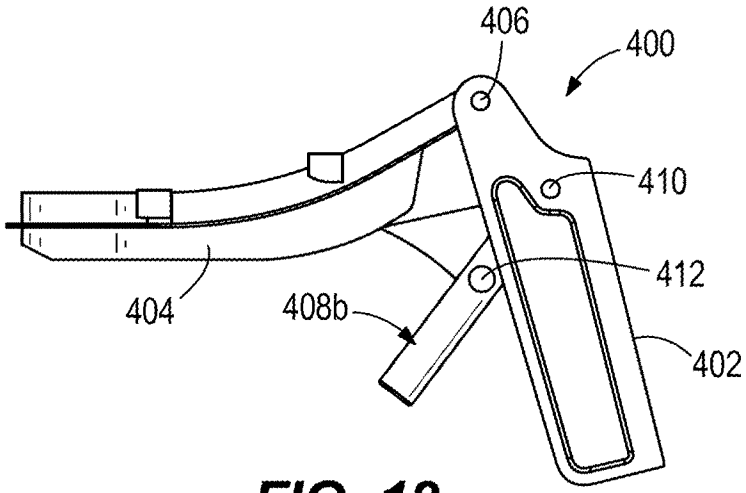
Figure 15:
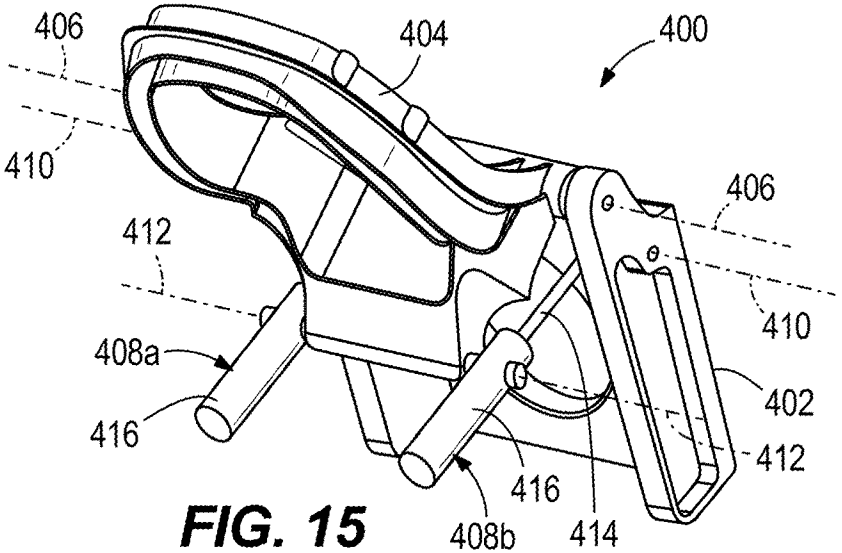
FIG. 15-16 are perspective and side views of a fourth embodiment, shown in a trimmed-up position.
Figure 16:
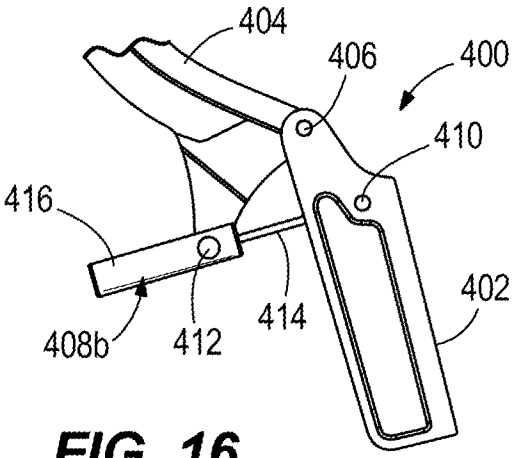
Figure 21:
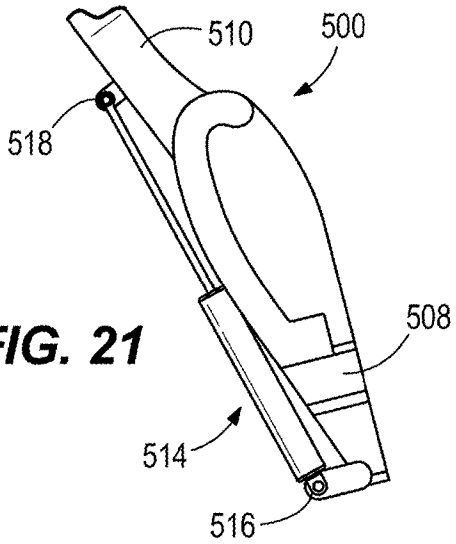
FIG. 21-22 are side and perspective views of the fifth embodiment, shown in a trimmed-up position.
Figure 22:
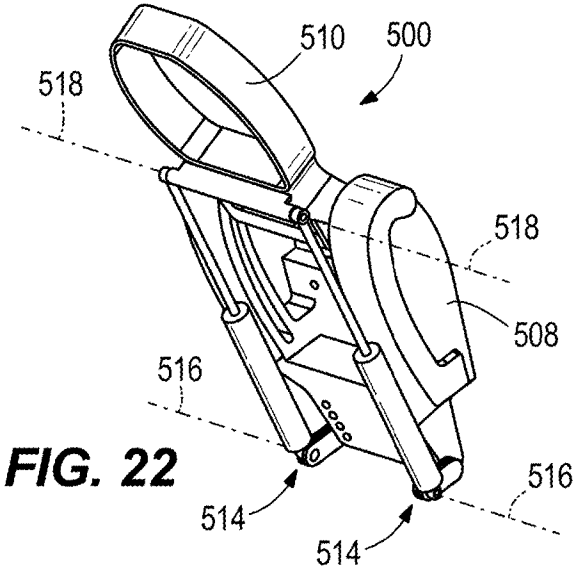
Figure 19:
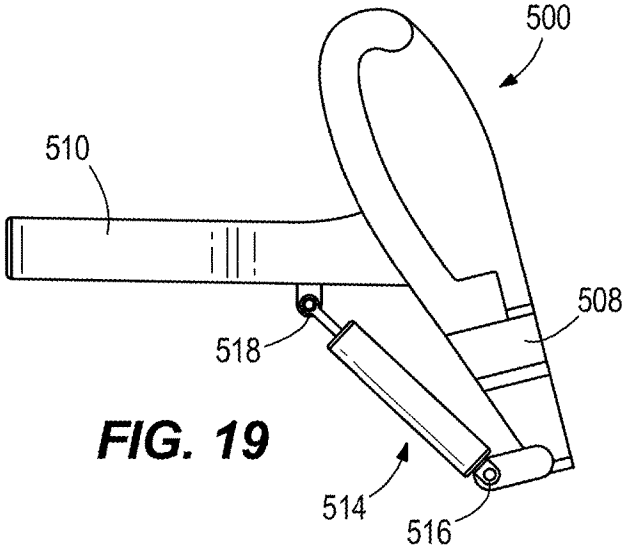
FIG. 19-20 are side and perspective views of a fifth embodiment, shown in a trimmed-down position.
Figure 20:
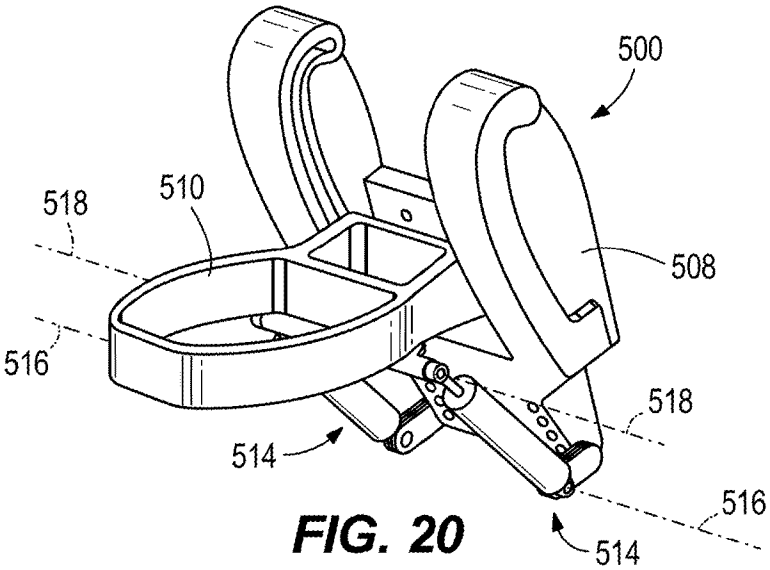
Figure 23:
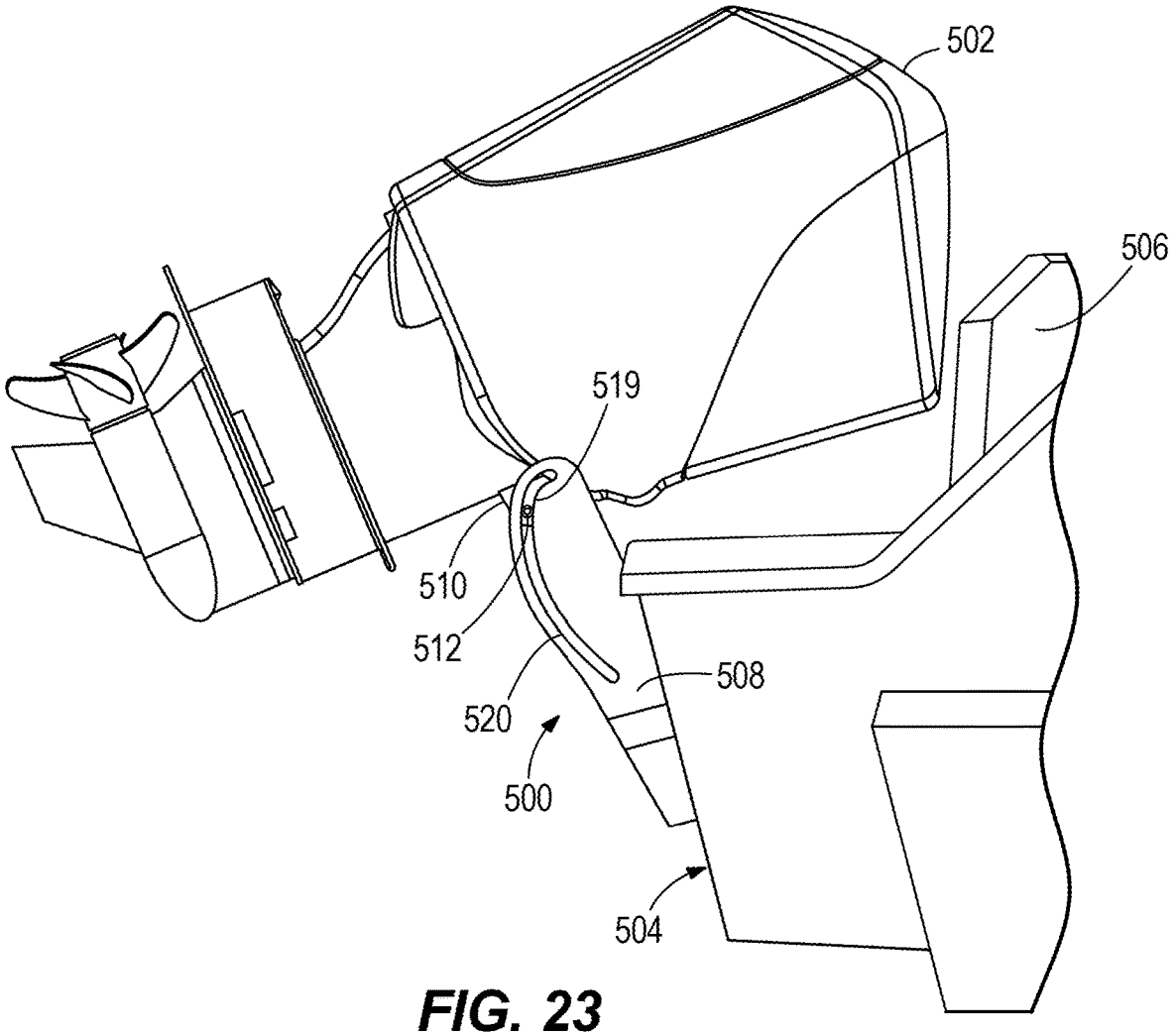
FIG. 23 is a side view of the fifth embodiment showing the outboard motor in the trimmed-up position.

FIGS. 8-10 depict a second embodiment of an apparatus 200 according to the present disclosure for supporting an outboard motor 202 with respect to a transom 204 of a marine vessel 206. The apparatus 200 includes a transom bracket 208 for fixed attachment to the transom 204. A supporting cradle 210 (the construction of which can vary and for example can be a supporting cradle like the one discussed herein above, or an adapter plate, or a supporting arm, and/or the like) pivotally supports the outboard motor 202 with respect to the transom bracket 208 along a trim axis 212. A trim actuator 214 is pivotally coupled to the lower end of the transom bracket 208 along a first trim actuator pivot axis 216 and to the supporting cradle 210 along a second trim actuator pivot axis 218. A tilt actuator 220 is pivotally coupled to the upper end of the transom bracket 208 along a first tilt actuator axis 222 and pivotally coupled to the top end of the trim actuator 214 along a second tilt actuator axis 223. The transom bracket 208 has first and second supporting arms 224, 226. The first supporting arm 224 is fixed to the transom 204 by conventional means, for example in a similar manner to that described herein above with respect to the first embodiment. The second supporting arm 226 has an upper portion that is coupled to the supporting cradle 210 and a lower portion that is pivotal with respect to the first supporting arm 224 along a lower supporting arm axis 228.

As can be seen by comparison of FIGS. 8-10 in sequence, the apparatus 200 facilitates movement of the trim axis 212 aftwardly of the transom 204 prior to and/or during trimming of the outboard motor 202 upwardly out of the water. FIG. 8 depicts the apparatus 200 in a trimmed-down position in which the outboard motor 202 is lowered into the water. Both the trim actuator 214 and the tilt actuator 220 are in a retracted position. FIG. 9 depicts the apparatus 200 upon extension of the tilt actuator 220, which can occur while the trim actuator 214 remains retracted. This moves the supporting cradle 210 and associated trim axis 212 aftwardly with respect to the transom 204, thus providing more clearance for the relatively large-sized outboard motor 202 once the trimming movement occurs. Extension of the tilt actuator 220 and movement of the trim axis 212 is facilitated by pivoting of the second supporting arm 226 with respect to the first supporting arm 224 along the noted lower supporting arm axis 228. FIG. 10 depicts the apparatus 200 upon extension of the trim actuator 214, which trims the outboard motor 202 upwardly about the trim axis 212 and out of the body of water. Extension of the tilt actuator 220 advantageously provides additional clearance 234 between the top cowl 230 of the outboard motor 202 and the transom well 232 of the marine vessel 206.

FIGS. 11-14 depict a third embodiment of an apparatus 300 that supports an outboard motor with respect to a transom of a marine vessel. The apparatus 300 includes a transom bracket 302 configured for fixed attachment to the transom and a supporting cradle 304 (e.g. cradle, adapter plate, and/or other type of supporting arm or bracket) that supports the outboard motor with respect to the transom bracket 302. The supporting cradle 304 is pivotal with respect to the transom bracket 302 about a trim axis 306. The apparatus 300 further includes a trim actuator 308 that in this example includes a pair of piston-cylinders 308*a*, 308*b*, each having a first end 310 coupled to the transom bracket 302 along a first actuator pivot axis 312 and a second end 314 coupled to the supporting cradle 304 along a second actuator pivot axis 316. The apparatus 300 further includes a gearing arrangement 318 that pivotally couples the supporting cradle 304 to the transom bracket 302. The gearing arrangement 318 includes a stationary gear 320 on the upper end of the transom bracket 302 and a climbing gear 322 on the end of the supporting cradle 304. The center axis of the climbing gear 322 defines the above-noted trim axis 306. As can be seen by comparison of the figures, extension of the trim actuator 308 causes a pivoting movement of the supporting cradle 304 with respect to the transom bracket 302. The stationary gear 320 and climbing gear 322 are connected together by end brackets 326 so that pivoting movement of the supporting cradle 304 causes the climbing gear 322 to rotate about the stationary gear 320. This effectively moves the trim axis 306 aftwardly (compare FIG. 13 to FIG. 11) with respect to the transom bracket 302 and associated transom and thus provides the additional clearance described above with respect to the marine vessel.

FIGS. 15-18 depict a fourth embodiment of an apparatus 400 for supporting an outboard motor on a transom of a marine vessel. The apparatus 400 includes a transom bracket 402 configured for fixed attachment to the transom. A supporting cradle 404 (e.g., cradle, adapter plate, arm, etc.) supports the outboard motor with respect to the transom bracket 402. As shown in the drawings, the supporting cradle 404 is pivotally attached to the transom bracket 402 along a trim axis 406. A trim actuator 408*a*, 408*b* is pivotally coupled to the transom bracket 402 along a first actuator pivot axis 410 and pivotally coupled to the supporting cradle 404 along a second actuator pivot axis 412. Similar to the first embodiment, the apparatus 400 is configured such that the trim axis 406 is located aftwardly of the first actuator pivot axis 410. The fourth embodiment differs from the first embodiment in that the trim actuator 408 includes a pair of piston rods 414 and a pair of cylinders 416 in which the piston rods 414 reciprocate, respectively. Each piston rod 414 is pivotally coupled to the transom bracket 402 along the first actuator pivot axis 410 and each cylinder 416 is pivotally coupled to the supporting cradle 404 along the second actuator pivot axis 412. Extension of the piston rods 414 from the cylinders 416 pivots the supporting cradle 404 upwardly about the trim axis 406. Retraction of the piston rods 414 into the cylinders 416 pivots the supporting cradle 404 downwardly about the trim axis 106.

FIGS. 19-23 depict a fifth embodiment of an apparatus 500 for supporting an outboard motor 502 on a transom 504 of a marine vessel 506. The apparatus 500 includes a transom bracket 508 configured for fixed attachment to the transom 504. A supporting cradle 510 supports the outboard motor 502 with respect to the transom bracket 508. The supporting cradle 510 is pivotable with respect to the transom bracket 508 about a trim axis 512. A trim actuator 514 includes a pair of piston-cylinders similar to embodiments discussed herein above. The piston-cylinders are pivotally coupled to the transom bracket 508 at a first trim actuator pivot axis 516 and to the supporting cradle 510 at a second trim actuator pivot axis 518. Extension of the trim actuator 514 pivots the supporting cradle 510 upwardly about the trim axis 512 and retraction of the trim actuator 514 pivots the supporting cradle 510 downwardly about the trim axis 512. The supporting cradle 510 is connected to the transom bracket 508 via one or more camming pins 519 engaged in camming slots 520 (see FIG. 23) that are curved along their length and extend in a convex shape with respect to the transom 504 along opposite sides of the transom bracket 508. The center axis of the camming pins 519 on the supporting cradle 510 thus defines the trim axis 512 As shown in the figures, upon extension of the trim actuator 514, the supporting cradle 510 is guided upwardly and aftwardly by the camming slots 520, which effectively moves the supporting cradle 510 and associated trim axis 512 upwardly and aftwardly with respect to the transom bracket 508. See FIG. 23. Upon retraction of the trim actuator 514, the camming slots 520 guide the supporting cradle 510 back downwardly and forwardly towards the transom 504.

The present disclosure thus provides several embodiments that locate or automatically move the trim axis aftwardly before, during and/or after the trimming movement, thus providing additional clearance between the outboard motor and the marine vessel, and particularly the top cowling and the motor well.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An apparatus for supporting an outboard motor on a transom of a marine vessel, the apparatus comprising:

a transom bracket configured for fixed attachment to the transom;

a supporting cradle that pivotally couples the outboard motor to the transom bracket along a trim axis; and a trim actuator that is pivotally coupled to the transom bracket at a first trim actuator pivot axis and pivotally coupled to the supporting cradle at a second trim actuator pivot axis, wherein extension of the trim actuator pivots the supporting cradle upwardly about the trim axis and wherein retraction of the trim actuator pivots the supporting cradle downwardly about the trim axis;

wherein the trim axis is located aftwardly of the first trim actuator pivot axis.

2. The apparatus according to claim 1, wherein the second trim actuator pivot axis is located vertically below the first trim actuator pivot axis when the trim actuator is retracted.

3. The apparatus according to claim 2, wherein the second trim actuator pivot axis is located aftwardly of the trim axis when the trim actuator is extended.

4. The apparatus according to claim 1, wherein the trim actuator comprises a piston rod and a cylinder in which the piston rod reciprocates, wherein the piston rod is pivotally coupled to the transom bracket at the first trim actuator pivot axis and the cylinder is pivotally coupled to the supporting cradle at the second trim actuator pivot axis, wherein extension of the piston rod from the cylinder pivots the supporting cradle upwardly about the trim axis, and wherein retraction of the piston rod into the cylinder pivots the supporting cradle downwardly about the trim axis.

5. The apparatus according to claim 4, wherein extension of the piston rod pivots the trim actuator upwardly about the trim axis and wherein retraction of the piston rod pivots the trim actuator back downwardly about the trim axis.

6. The apparatus according to claim 4, wherein the cylinder has a first end and a second end and wherein the second trim actuator pivot axis is located between the first and second ends.

7. The apparatus according to claim 6, wherein the first end is located closer to the first trim actuator pivot axis than the second end, and wherein second trim actuator pivot axis is located closer to the first end than the second end.

8. The apparatus according to claim 7, wherein extension and retraction of the piston rod pivots the trim actuator about the first trim actuator pivot axis.

9. The apparatus according to claim 1, wherein the trim actuator comprises a pair of piston rods and a pair of cylinders in which the piston rods reciprocate, respectively, wherein each piston rod is pivotally coupled to the transom bracket at the first trim actuator pivot axis and each cylinder is pivotally coupled to the supporting cradle at the second trim actuator pivot axis, wherein extension of the piston rods from the cylinders pivots the supporting cradle upwardly about the trim axis, and wherein retraction of the piston rods into the cylinders pivots the supporting cradle downwardly about the trim axis.

10. The apparatus according to claim 1, wherein the supporting cradle comprises at least one resilient mounting member that couples the supporting cradle to the outboard motor so that the outboard motor is resiliently supported by the supporting cradle.

11. The apparatus according to claim 1, wherein the transom bracket comprises opposing bracket arms and wherein the trim actuator is disposed between the opposing bracket arms.

12. The apparatus according to claim 11, wherein the opposing bracket arms are coupled to the supporting cradle along the trim axis.

13. The apparatus according to claim 12, further comprising opposing bushings that couple the bracket arms to the supporting cradle along the trim axis.

14. The apparatus according to claim 12, wherein the transom bracket further comprises a bridge that connects the opposing bracket arms and wherein the piston rod is coupled to the bridge along the first trim actuator pivot axis.

15. The apparatus according to claim 12, wherein the supporting cradle comprises a supporting cradle body that supports the outboard motor and opposing supporting arms that extend forwardly from the supporting cradle body towards the transom bracket.

16. The apparatus according to claim 15, further comprising opposing bushings that couple the opposing supporting arms to the cylinder along the second trim actuator pivot axis.

17. The apparatus according to claim 15, wherein the opposing supporting arms have lower ends that are connected together by a brace.

18. The apparatus according to claim 17, further comprising a resilient mounting member that couples the brace to the outboard motor so that the outboard motor is resiliently supported by the brace.

19. The apparatus according to claim 18, wherein further comprising additional resilient mounting members that couple the supporting cradle body to the outboard motor so that the outboard motor is resiliently supported by the supporting cradle body.

20. The apparatus according to claim 15, wherein the opposing bracket arms comprise upwardly extending ears and wherein the supporting cradle body is coupled to the upwardly extending ears along the trim axis.

21. The apparatus according to claim 20, further comprising opposing bushings that couple the supporting cradle body to the upwardly extending ears along the trim axis.

22. An apparatus for supporting an outboard motor on a transom of a marine vessel, the apparatus comprising:

a transom bracket configured for fixed attachment to the transom;

a supporting cradle that supports the outboard motor with respect to the transom bracket, wherein the supporting cradle is pivotable with respect to the transom bracket about a trim axis; and a trim actuator comprising a piston rod and a cylinder in which the piston rod reciprocates, wherein the piston rod is pivotally coupled to the transom bracket at the first trim actuator pivot axis and the cylinder is pivotally coupled to the supporting cradle at the second trim actuator pivot axis, wherein extension of the trim actuator pivots the supporting cradle upwardly about the trim axis and wherein retraction of the trim actuator pivots the supporting cradle downwardly about the trim axis;

wherein extension of the piston rod pivots the trim actuator upwardly about the trim axis and wherein retraction of the piston rod pivots the trim actuator back downwardly about the trim axis.

23. The apparatus according to claim 22, wherein the cylinder has a first end and a second end and wherein the second trim actuator pivot axis is located between the first and second ends.

24. The apparatus according to claim 23, wherein the trim axis is located aftwardly of the first trim actuator pivot axis.

25. The apparatus according to claim 24, wherein the second trim actuator pivot axis is located vertically below the first trim actuator pivot axis when the trim actuator is retracted.

26. The apparatus according to claim 25, wherein the second trim actuator pivot axis is located aftwardly of the trim axis when the trim actuator is extended.

27. An apparatus for supporting an outboard motor on a transom of a marine vessel, the apparatus comprising:

a transom bracket configured for fixed attachment to the transom;

a supporting cradle that supports the outboard motor with respect to the transom bracket, wherein the supporting cradle is pivotable with respect to the transom bracket about a trim axis;

a trim actuator that is pivotally coupled to the transom bracket at a first trim actuator pivot axis and to the supporting cradle at a second trim actuator pivot axis, wherein extension of the trim actuator pivots the supporting cradle upwardly about the trim axis and wherein retraction of the trim actuator pivots the supporting cradle downwardly about the trim axis; and a tilt actuator that is pivotally coupled to the transom bracket at a first tilt actuator pivot axis and to the trim actuator at a second tilt actuator pivot axis, wherein extension of the tilt actuator moves the supporting cradle and trim axis aftwardly away from the transom and wherein retraction of the tilt actuator moves the trim axis forwardly towards the transom.

28. An apparatus for supporting an outboard motor on a transom of a marine vessel, the apparatus comprising:

a transom bracket configured for fixed attachment to the transom;

a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis, wherein extension of the trim actuator pivots the supporting cradle upwardly about the trim axis and wherein retraction of the trim actuator pivots the supporting cradle downwardly about the trim axis; and a climbing gear that connects the supporting cradle to a stationary gear on the transom bracket, wherein extension of the trim actuator causes the climbing gear to rotate about the stationary gear which effectively moves the trim axis upwardly and aftwardly relative to the transom bracket.

29. An apparatus for supporting an outboard motor on a transom of a marine vessel, the apparatus comprising:

a transom bracket configured for fixed attachment to the transom;

a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis, wherein extension of the trim actuator pivots the supporting cradle upwardly about the trim axis and wherein retraction of the trim actuator pivots the supporting cradle downwardly about the trim axis;

wherein the supporting cradle is connected to the transom bracket via a camming slot along which the supporting cradle and the trim axis move when the trim actuator is actuated, wherein the camming slot guides the supporting cradle and the trim axis upwardly and aftwardly with respect to the transom bracket.

* * * * *